US005289144A

United States Patent [19]

Liao

[11] Patent Number: 5,289,144

[45] Date of Patent: Feb. 22, 1994

[54] ELECTROMAGNETIC RELAY AND METHOD FOR ASSEMBLING THE SAME

[75] Inventor: Shangshyan Liao, Ypsilanti, Mich.

[73] Assignee: Potter & Brumfield, Inc., Princeton, Ind.

[21] Appl. No.: 930,023

[22] Filed: Aug. 21, 1992

[51] Int. Cl.[5] ..... H01H 51/22

[52] U.S. Cl. ..... 335/78; 335/83

[58] Field of Search ..... 335/78-86, 335/104, 121, 133, 128, 202

[56] References Cited

U.S. PATENT DOCUMENTS

| | | | |
|---|---|---|---|
| 3,230,329 | 1/1966 | Richert et al. | 200/104 |
| 4,486,727 | 12/1984 | Freeman et al. | 335/106 |
| 4,618,842 | 10/1986 | Nestlen et al. | 335/128 |
| 4,958,137 | 9/1990 | Schroeder | 338/128 |

FOREIGN PATENT DOCUMENTS 2627168 of 0000 Fed. Rep. of Germany .

OTHER PUBLICATIONS

Article by Nakabayashi et al. in Proceedings 39th Relay Conference Apr. 22-24, 1992, National Association of Relay Manufacture entitled, "Development of a Highly Sensitive Subminiature Power Relay."

Article by Mitschik et al. in Siemens Components, vol. XXIV, Dec. 1989, entitled "MSR—A Relay With 8-mm Clearance and Creepage Distances."

*Primary Examiner*—Lincoln Donovan

*Attorney, Agent, or Firm*—Joseph S. Codispoti

[57] ABSTRACT

The relay comprises a flat base, a motor unit mounted on the base, an armature arranged on one end of the motor unit to actuate a contact arrangement fastened on the base at the other end of the motor unit. The movement of the armature upon energization or de-energization of the motor unit is transferred to the contact arrangement by means of a pusher arranged above the motor unit. The pusher is clamped to the armature by means of a multi-functional retainer spring which serves also for fastening the armature to a frame and for biasing the armature into its rest position. The motor unit is inserted with terminals and bobbin posts into oblong holes of the base so as to be displaceable in an actuating direction for adjusting a contact gap or overtravel during assembly of the relay and before securing the motor unit to the base.

12 Claims, 2 Drawing Sheets

ELECTROMAGNETIC RELAY AND METHOD FOR ASSEMBLING THE SAME

TECHNICAL FIELD

The present invention relates to electromagnetic relays, and more particularly to an electromagnetic relay comprising a flat insulated base, a motor unit mounted on the base, contact members fastened in the base at one end of the motor unit, and an armature arranged on the other end of the motor unit for actuating said contact members upon energization and de-energization of the motor unit.

BACKGROUND OF THE INVENTION

A relay of the kind described above is already known from U.S. Pat. No. 4,618,842. In this known relay, a motor system is arranged on a base, an armature of the motor being arranged at one end of the coil and contact units being provided at the other end of the coil actuated by a pusher arranged above the magnet coil. The contact elements are secured in the base by embedding and the motor system is fixedly connected to the base by means of stops or mating surfaces of the base. Disadvantageously, tolerances of the contact elements and their fastening on one side and of the motor system, including frame and core as well as the armature and pusher, on the other side can accumulate causing deviations of contact gaps or contact overtravel. Consequently, under certain circumstances, erosion safety is not guaranteed.

Further, in the known relay, the armature rests in a groove provided in a bobbin extension, a prolongation of the bobbin or a spring member biasing the armature into its rest position. For coupling the pusher to the armature, the pusher has pins projecting through openings of switching springs. With this kind of coupling, the armature cannot exert a restoring or biasing force against the contact springs. Consequently, in the case of the welding of a contact, a risk exists that the pusher cannot be restored or that the pusher can be restored only by one of a plurality of contact springs causing an indefinite or undesired switching condition.

It is, therefore, an object of the present invention to provide an electromagnetic relay having a simple structure with a simple adjustment between contact elements and the motor unit during assembly.

It is another object of the present invention to provide an electromagnetic relay with a simple adjustment of the motor unit on the base before securing it on the base.

It is still another object of the present invention to provide an electromagnetic relay in which the pusher is reliably coupled to the armature.

It is still another object of the present invention to provide an electromagnetic relay in which the armature is fastened to the yoke and the pusher is coupled to the armature by only one retainer spring.

It is still another object of the present invention to provide a method for assembling an electromagnetic relay and adjusting the same during assembly.

SUMMARY OF THE INVENTION

The aforementioned problems are obviated by the present invention which provides an electromagnetic relay comprising:

(a) a flat insulating base;

(b) a motor unit mounted on said base, comprising a coil, an iron core, and a frame;

(c) an armature pivoted on an end edge of said frame and having a free end movable in an actuating direction parallel to said base upon energization and de-energization of said coil;

(d) at least one contact group comprising a movable contact spring and at least one stationary contact member fastened to said base and extending nearly perpendicular thereto; and (e) an insulated pusher connected to the movable end of said armature and to a movable end of said at least one movable contact spring so as to actuate said movable contact spring in accordance with said armature, said coil including a bobbin having at least one post extending downward for mounting the motor unit to the base, said base having at least one oblong mounting hole formed therein for receiving said at least one post, and said mounting hole allowing the motor unit to be displaced in the actuating direction before being secured to the base.

According to another aspect of the present invention, there is provided an electromagnetic relay comprising:

(a) a flat insulating base;

(b) a motor unit mounted on said base, comprising a coil, an iron core, and a frame;

(c) an armature pivoted on an end edge of said frame and having a free end movable in an actuating direction parallel to said base upon energization or de-energization of said coil;

(d) at least one contact group comprising a movable contact spring and at least one stationary contact member fastened to said base and extending nearly perpendicular thereto;

(e) an insulated card-like pusher connected to said free end of said armature and to a movable end of said at least one contact spring so as to actuate said contact spring in accordance with a movement of said armature; and (f) an armature retainer spring fastened to said armature and coupled to said frame, said retainer spring having a first section extending between the base and the frame and being fastened to said frame, a second section extending nearly perpendicular to said first section, being fastened to an outer surface on said armature and biasing said armature by an acute angle away from the core, and a third section forming at least one claw member that clamps said pusher to the free end of the armature.

BRIEF DESCRIPTION OF THE DRAWINGS

For a better understanding of the invention, reference is made to the following description cf an exemplary embodiment thereof, and to the accompanying drawings, wherein.

DETAILED DESCRIPTION

Figure 1:
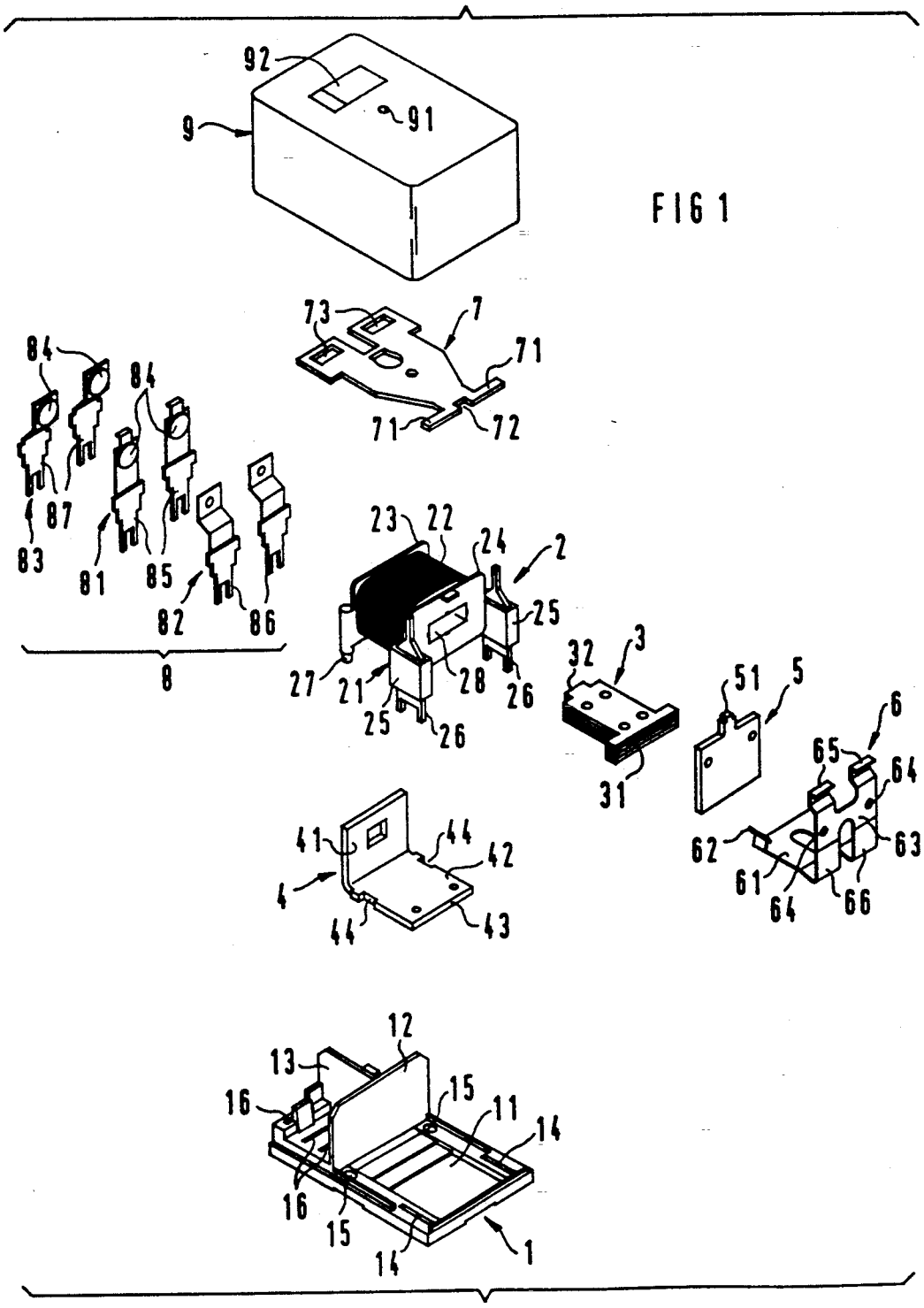
FIG. 1 is a perspective view of a dissembled electromagnetic relay constructed in accordance with the present invention.
Figure 2:
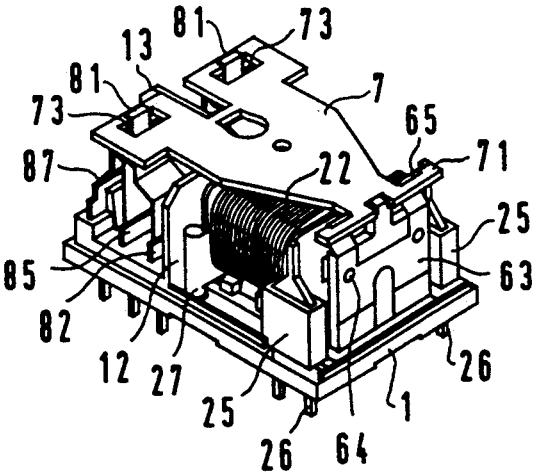
FIG. 2 is a perspective view of the partially assembled relay of FIG. 1.

The relay illustrated in the drawings has an insulated base 1, which may be made from plastic. The base 1 generally is shaped in the form of a flat plate having through holes and steps for receiving the other relay parts. An electromagnetic motor system is arranged on the base 1 that comprises a coil 2, a core 3, a frame 4, and a movable armature 5 which is fastened to the frame 4 via a retainer spring 6. The motor system further comprises a card-like pusher 7 which is at one end connected to the armature 5 by means of said retainer spring 6. The other end of the pusher 7 actuates a contact arrangement 8. A cover 9 is attached to the base 1 to form a closed housing for the relay.

The base 1 has a stepped bottom part 11 for receiving the motor system. The base 1 also has a vertical transverse partition wall 12 for separating and insulating the motor system from the contact arrangement 8 and a longitudinal partition wall 13 for insulating two separate contact units or groups of the contact arrangement 8. The bottom part 11 has formed therein longitudinal slots 14 for receiving coil terminals 26 and oblong holes 15 for receiving fastening posts 27 of the coil 2. The base 1 also has formed therein inserting slots 16 for fastening terminals of the contact arrangement 8.

The coil 2 comprises a bobbin 21 with a wiring 22 arranged between two flanges 23 and 24. The coil terminals 26 are secured, for example, by being embedded, in extensions 25 of one of the flanges 24. Further, fastening posts 27 are formed integral with the other flange 23 on both sides thereof. An axial throughhole 2 formed by the bobbin 21 serves for receiving the core 3. The core 3 can be made from solid or laminated iron. On one end thereof, the core 3 forms a polar surface 31 while at the other end 32 thereof the core 3 is connected to a first leg 41 of the frame 4. A second leg 42 of the frame 4 extends below the coil 2, i.e., between the wiring 22 and the base 1.

At its free end, the second leg 42 of the frame 4 forms a hinge or pivot edge 43 on which the plate-like armature 5 is pivoted. The armature 5 is fastened to the frame 4 by the retainer spring 6 which has a first section 61 positioned at the underside of the second leg 42 of the frame 4 and secured thereto by means of latching tabs 62 in corresponding recesses 44 on the frame 4. A second section 63 of the retainer spring 6 extends nearly perpendicular to the first section 61 and rests on an outer surface of the armature 5, being connected to the armature 5, for example, through welding points 64. A third section of the retainer spring 6 includes two spring claws 65 for clamping the pusher 7.

The card-like pusher 7 has formed on one end thereof two wings or webs 71 extending in a transversal direction of the pusher 7 by which the spring claws 65 of the retainer spring 6 are engaged, and a central recess 72 that mates to a dent 51 of the armature 5. At its other end, the pusher 7 has formed therein two actuating windows 73 engaged by the ends of movable contact springs to be described below.

Figure 3:
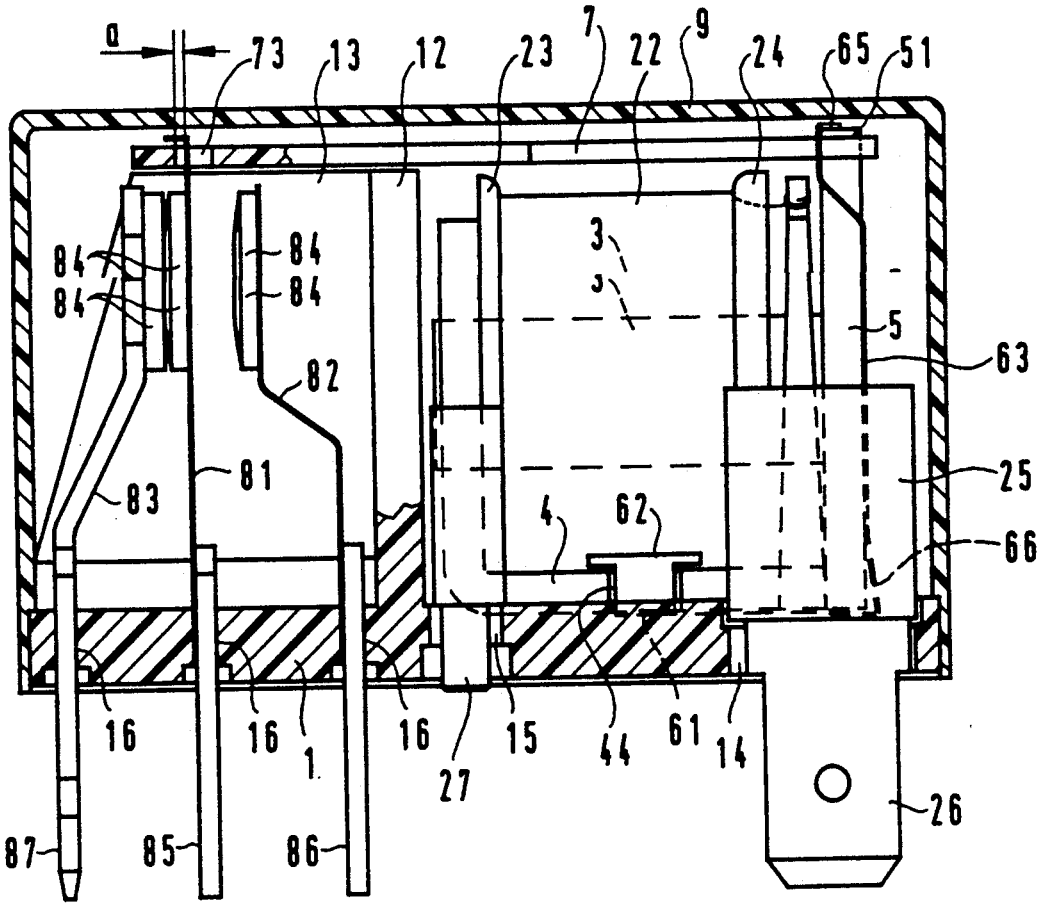
FIG. 3 is a side view of the assembled relay of FIGS. 1 and 2 with minor modifications, with the cover and the base partly cut away.

The contact arrangement 8 has two contact units or groups each having a movable contact spring 81, a normally closed contact spring 82 and a normally open contact arm 83. Each of the contact elements has contacts or contact pieces 84 made from commonly known contact materials. The movable contact springs 81 as well as the normally closed contact springs 82 each have welded or riveted terminals 85, 86, while the normally closed contact arms 83 have respective integrally formed terminals 87. By means of the terminals 85, 86, 87, the contact elements are secured within the inserting slots 16 of the base 1. The terminals 85, 86, 87 extend out from the underside of the base 1 and can be formed in any conventional manner, for example, with pairs on soldering pins as shown in FIG. 1 or with flat plug or quick connect terminals as shown in FIG. 3. Other shapes of terminals 85, 86, 87 than those illustrated are also possible. In addition, the contact arrangement 8 can be varied, for example, only normally closed on normally open contact combinations can be provided as well as more than two contact units.

When assembling the relay, the motor unit is put together first. For example, the core 3 is first inserted into the throughhole 28 of the bobbin 21 and the frame 4 is connected with the core 3. The armature 5 is then fastened to the frame 4 by means of the retainer spring 6. The second leg 42 of the frame 4 extends along the underside of the coil 2, lying between the bottom part 11 of the base 1 and the wiring 22 of the bobbin 21 when the motor system is mounted on the base 1. The stepped shape of the bottom part 11 of the base 1 is configured to accept the retainer spring 6 and gives enough clearance for the retainer spring 6 in a bending region 66 of the spring 6 where it is bent for pre-biasing. Note that before the motor system is mounted on the base 1, the contact arrangement 8 has been mounted on the base 1 by inserting the terminals 85, 86, 87 into the inserting slots 16 of the base 1.

After mounting the motor system, the pusher 7 is arranged on the top of the coil 2, the spring claws 65 of the retainer spring 6 engaging the wings or webs 71 and the angled ends of the movable contact springs 81 of the contact arrangement 8 engaging the actuating windows 73. The retaining or biasing force of the retainer spring 6 biases the armature 5 into its rest position, i.e., away from the pole surface 31 of the core 3. The pusher 7 is also biased into its rest position by the retaining force of the retainer spring 6.

In operation, when the relay is energized, the armature 5 closes on the core 3 and moves the pusher 7, overcoming the retaining force of the retainer spring 6 and letting the pre-biased contact springs 81 close on the stationary normally open contact arms 83. Upon de-energization, the pre-biased contact springs 81 and the retainer spring 6 move the pusher 7 to open the contacts and return the armature 5 to its open gap position.

FIG. 3 shows a side view of the relay, with minor modifications and with the cover 9 and the base 1 partly cut away to more clearly illustrate the procedure of adjusting the position of the motor system. To enable adjustment of the distance between the motor system and the contact arrangement 8, the elongated slots 14 and the oblong holes 15 of the base 1 have a diameter at least in the actuating direction so that the coil terminals 26 and the fastening posts 27 are first mounted with clearance in the respective openings. During assembly, the pre-mounted motor system is energized so as to let the armature 5 come into its attracted position (as shown in FIG. 3) and actuate, via the pusher 7, the movable contact springs 81. In response, the movable contact springs 81 contact the normally open contact arms 83. When the contacts 84 of these elements contact each other, a small movement of the pusher 7 occurs until the armature 5 contacts the core 3. With this additional movement, the actuating windows 73 of the pusher 7 come out of engagement with the movable contact springs 81 by a distance "a". This is the desired overtravel which is necessary for safety of contact. In particular, this overtravel "a" has to be such that even after a certain erosion of the contacts 84 during the lifetime of the relay, a safe contacting is guaranteed. If the overtravel "a" is too short, the motor system during assembly, with the coil terminals 26 in the elongated slots 14 and with the fastening posts 27 in the oblong holes 15, can be displaced in the actuating direction until the desired overtravel is reached.

Thereafter, the motor system can be secured to the base 1, for example, by applying curable epoxy or the like into the elongated slots 14 and the oblong holes 15. The motor system can also be secured to the base 1 by heat melting the bobbin fastening posts 27 within the respective oblong holes 15.

The relay is closed by snapping the cover 9 on the base 1 by locking tabs (not shown). The housing may be sealed by applying epoxy in the inserting slots 16 and the slots between the base 1 and the cover 9 or, if desired, left in an unsealed condition. As shown in FIG. 1, a vent hole 91 is provided for the cover 9. Also, a window 92 can be provided for the cover 9 which allows for viewing of the switching function. The window 92 can be opened for venting purposes or closed with a tape.

The embodiments described herein are merely illustrative of the principles of the present invention. Various modifications may be made thereto by persons ordinarily skilled in the art, without departing from the scope or spirit of the invention.

What is claimed is:

1. An electromagnetic relay comprising:

a flat insulating base;

a motor unit mounted on said base, comprising a coil, an iron core and a frame;

an armature pivoted on an end edge on said frame and having a free end movable in an actuating direction parallel to said base upon energization and de-energization of said coil;

at least one contact group comprising a movable contact spring and at least one stationary contact member fastened to said base and extending nearly perpendicular thereto;

an insulated pusher connected to said movable end of said armature and to a movable end of said at least one movable contact spring so as to actuate said movable contact spring in accordance with said armature, said coil including a bobbin having at least one post extending downward for mounting the motor unit to the base, said base having at least one oblong mounting hole formed therein for receiving said at least one post, and said mounting hole allowing the motor unit to be adjustably displaced in the actuating direction prior to complete assembly, to establish a predetermined contact gap.

2. The relay according to claim 1, wherein said bobbin further comprises a pair of end flanges and a wiring therebetween, at least one of the flanges supporting coil terminals and, wherein, said base has oblong mounting slots formed therein for receiving said coil terminals and allowing the motor unit inclusive of the coil terminals to be adjustably displaced in the actuating direction prior to complete assembly, to establish a predetermined contact gap.

3. The relay according to claim 1, further comprising a contact structure comprising at least a pair of said contact groups fastened to said base and, wherein, said base further comprises a first partition wall insulating said coil from said contact structure and a second partition wall separating different contact groups from each other.

4. The relay according to claim 3, wherein said pusher is configured in a card-like form and arranged above said coil parallel to said base and, wherein, said first and second partition walls form separated contact compartments each having an open upper side which is partly covered by said pusher.

5. An electromagnetic relay, comprising:

a flat insulating base;

a motor unit mounted on said base, comprising a coil, an iron core and a frame;

an armature pivoted on an end edge of said frame and having a free end movable in an actuating direction parallel to said base upon energization or de-energization of said coil;

at least one contact group comprising a movable contact spring and at least one stationary contact member fastened to said base and extending nearly perpendicular thereto;

an insulated card-like pusher connected to said free end of said armature and to a movable end of said at least one contact spring so as to actuate said contact spring in accordance with a movement of said armature; and an armature retainer spring fastened to said armature and coupled to said frame, said retainer spring having a first section extending between the base and the frame and being fastened to said frame, a second section extending nearly perpendicular to said first section, being fastened to an outer surface of said armature and biasing said armature by an acute angle away from the core, and a third section forming at least one claw member that clamps said pusher to the free end of the armature.

6. The relay according to claim 5, wherein said pusher has at least one recess formed in an end edge facing the armature and at least one web formed in the region of said end edge, the at least one claw member of the retainer spring trapping said web and biasing the pusher against at least one dent formed on the free end on the armature and fitting into said at least one recess.

7. The relay according to claim 5, wherein said pusher has a central recess formed in an end edge facing the armature and a pair of wings extending from either side of the recess, and said retainer spring further comprises a pair of claws each trapping one of said wings and biasing the pusher against a dent formed on the free end of the armature and fitting into said recess.

8. The relay according to claim 6, wherein said first section of the retainer spring further comprises latching tabs formed on lateral side edges thereof that fixedly engage respective recesses formed in the frame.

9. The relay according to claim 6, wherein said base further comprises a rib extending transversally under the frame and the first section of the retainer spring, said rib urging the first section against the frame.

10. A method of assembling the relay according to claim 1, comprising the steps of:

inserting the stationary contact members and movable contact springs into respective slots of the base;

superimposing the motor unit onto the base while inserting the bobbin fastening posts into respective oblong holes of the base and leaving a clearance therein;

superimposing the pusher onto the motor unit and connecting one end thereof with the movable contact springs and the other end thereof with the armature;

connecting coil terminals to an energizing voltage source and energizing the coil;

displacing the bobbin fastening posts in the respective oblong holes so as to displace the motor unit in the actuating direction until a predetermined contact gap or overtravel is achieved; and securing the motor unit to the base.

11. The method according to claim 10, wherein said securing the motor unit comprises filling in and curing a sealing compound into the oblong holes of the base with the bobbin fastening posts inserted therein.

12. The method according to claim 10, wherein said securing the motor unit comprises heat melting one or more bobbin fastening posts within a respective oblong hole of the base.

* * * * *